US007942404B2

(12) United States Patent
Cha et al.

(10) Patent No.: US 7,942,404 B2
(45) Date of Patent: May 17, 2011

(54) DEVICE OF SUPPLYING PAPER MEDIUM

(75) Inventors: Jin Hwan Cha, Anyang-si (KR); Je Seok Kong, Busan (KR); Won Joon Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 107 days.

(21) Appl. No.: 12/331,222

(22) Filed: Dec. 9, 2008

(65) Prior Publication Data

US 2009/0152799 A1 Jun. 18, 2009

(30) Foreign Application Priority Data

Dec. 12, 2007 (KR) ..... 10-2007-0128950
Dec. 31, 2007 (KR) ..... 10-2007-0141768

(51) Int. Cl.
*B65H 1/26* (2006.01)
*B65H 1/04* (2006.01)

(52) U.S. Cl. ..... 271/171; 271/145; 271/162

(58) Field of Classification Search ..... 271/171, 271/145, 162; 399/393
See application file for complete search history.

(56) References Cited

U.S. PATENT DOCUMENTS

| | | | | |
|---|---|---|---|---|
| 3,658,320 | A * | 4/1972 | Kuehn | 271/144 |
| 6,412,772 | B1 * | 7/2002 | Itoh et al. | 271/145 |
| 7,097,172 | B2 * | 8/2006 | Chang | 271/171 |
| 7,676,190 | B2 * | 3/2010 | Kitamura et al. | 399/393 |
| 2004/0253032 | A1 * | 12/2004 | Kojima | 400/101 |

* cited by examiner

*Primary Examiner* — Stefanos Karmis
*Assistant Examiner* — Luis A Gonzalez
(74) *Attorney, Agent, or Firm* — Fenwick & West LLP

(57) ABSTRACT

A medium supply device includes a receiving portion including a support plate to form a bottom surface of the receiving portion, a support portion being formed on the support plate to support a central portion of a bottom surface of paper medium, and a guide being formed on the support plate to limit both sides of paper medium around the support portion; a separating portion being provided in front of the receiving portion to pick up and discharge the paper medium; and a pressurizing portion including a block to move forward and backward with respect to the receiving portion and a plate of which a location is adjustable upwardly and downwardly along the block, wherein the guide is formed in parallel with a transferring direction of the paper medium and includes a plurality of protrusions.

6 Claims, 10 Drawing Sheets

DEVICE OF SUPPLYING PAPER MEDIUM

CROSS-REFERENCE TO RELATED APPLICATIONS

This application claims the benefit of Republic of Korea Patent Application No. 10-2007-0128950, filed on Dec. 12, 2007, and Republic of Korea Patent Application No. 10-2007-0141768, filed on Dec. 31, 2007, in the Korean Intellectual Property Office, the disclosures of which are incorporated herein by reference.

BACKGROUND

1. Field of the Invention

The present invention relates to a medium supply device, and more particularly, to a medium supply device or structure for storing and supplying paper money, checks, and the like, such as a cassette in a cash transaction machine.

2. Description of the Related Art

A cash transaction machine denotes an automated device that may provide basic financial services such as deposit and withdrawal in association with financial services, without a need of a banking teller and without a restriction on a time and an occasion.

The cash transaction machine may be generally classified into a cash withdrawing device and a cash depositing device depending on whether a deposit or a withdrawal is performed. Currently, the cash transaction machine is being used for various purposes such as depositing/withdrawing of a check, a bankbook arrangement, depositing of a gyro, ticketing, and the like.

Paper media such as cash, checks, and the like are used in the cash transaction machine. In order to discharge the paper media, the cash transaction machine includes a receiving portion to receive the paper media, a discharging portion to externally discharge the paper media, and a pressurizing portion to pressurize the rear surface of paper media to be movable to the discharging portion, and a cover portion to cover an upper portion of the paper media.

The discharging portion may be provided as an external type or an internal type. When the discharging portion is the external type, the discharging portion may be provided in a separate device such as a cassette, a storage section, and the like. When the discharging portion is the internal type, the discharging portion may be integrally provided with the storage section, the cassette, and the like and thereby be installed in the device. In particular, when the discharging portion is in the external type, the discharging portion may pick up an upper portion of the paper media to be discharged.

In this case, the pressurizing portion may pressurize the upper portion of paper media to be closely attachable to the separating portion. Since the size and length of paper media provided in the receiving portion varies according to a type of paper, there is a need to adjust the pressurizing portion.

The paper media such as cash, checks, and the like may be used for the cash transaction machine. The paper media does not move along the same route but may need to change the route depending on cases. When a skewed paper medium is provided in the cash transaction machine, the skewed paper medium may cause a jam in the cash transaction machine itself while passing through the complex route.

When the discharging portion is in the external type, the discharging portion may pick up the upper portion of paper media and discharge the same to an upward direction of the cassette, the storage direction, and the like. Also, a receiving portion may be provided to load the paper media and move the loaded paper media to the discharging portion. There is a need to adjust the receiving portion according to a transfer of the paper media to make it possible to upwardly discharge the paper media.

SUMMARY

An aspect of the present invention provides a medium supply device that may prevent a paper medium from becoming skewed during a process of supplying paper media.

Another aspect of the present invention also provides a medium supply device that may improve irregular loading of paper media in a cassette, a paper money storage section, and the like.

Another aspect of the present invention also provides a medium supply device that may easily discharge paper media from a cash transaction machine according to a type of paper.

Another aspect of the present invention also provides a medium supply device that includes a device capable of effectively pressurizing the rear surface of paper media.

Another aspect of the present invention also provides a medium supply device that may guide both sides of paper media along a traveling direction of the paper media.

Another aspect of the present invention also provides a medium supply device that may reduce friction with paper media while the paper media is being transferred and thereby may smoothly transfer the paper media.

According to an aspect of the present invention, there is provided a medium supply device including: a receiving portion to receive a paper medium; a separating portion being provided in a front top of the receiving portion to upwardly pick up and discharge the paper medium; and a pressurizing portion comprising a block to move forward and backward with respect to the receiving portion and a plate of which a location is adjustable upwardly and downwardly along the block. Since the location of the plate is adjustable with respect to the block, the plate may change its location to support the paper medium according to a type of paper. It is possible to improve a pick-up and discharge efficiency by adjusting an optimal location of the plate.

A combining portion of the pressurizing portion may be integrally provided with the plate and the combining portion may include at least one long hole. In this instance, a plurality of long holes may be formed on a side of the combining portion. Also, the combining portion may be formed on the rear of the block from both sides of the block to thereby partially receive the rear of the block.

A screw hole may be formed on the side of the block to correspond to the long hole of the combining portion. The screw hole may be tilted along the side of the block to be combinable with the combining portion using a portion of the long hole and a fixing member.

In particular, the pressurizing portion may be tilted toward a lower end of the pressurizing portion from an upper end of the pressurizing portion based on the receiving portion. The pressurizing portion functions to push the paper medium toward the separating portion so that the paper medium may be picked up via the separating portion. An upper edge of the plate may be protruded further than a lower edge of the plate so that the upper portion of paper medium may make close contact with the separating portion to thereby be smoothly discharged.

The receiving portion may include a support plate to support a bottom surface of the paper medium, and the support plate may be upwardly and downwardly movable and fixable with respect to the separating portion. The support plate may be upwardly and downwardly adjustable according to the length of the shortest side of the paper medium. A fixing plate may be formed on each of both sides of the support plate to upwardly and downwardly adjust the support plate and thereby fix the support plate. A plurality of tilted screw holes may be formed on the fixing plate to make it possible to adjust an approximate location when the support plate is upwardly and downwardly adjusted.

Also, the receiving portion may further include a medium guide of which the width is adjustable and that is fixed to the support plate to limit both sides of the paper medium. Since a different size and longest side is required according to a type of paper, the medium guide may include a protrusion to appropriately adjust a length and receive the paper medium.

According to another aspect of the present invention, there is provided a medium supply device including: a receiving portion comprising a support plate to form a bottom surface of the receiving portion, a support portion being formed on the support plate to support a central portion of the bottom surface of a paper medium, and a guide being formed on the support plate to limit both side surfaces of the paper medium around the support portion; a separating portion being provided in front of the receiving portion to pick up and discharge the paper medium; and a pressurizing portion to pressurize the paper medium from the receiving portion to the separating portion, wherein the guide is formed in parallel with a transferring direction of the paper medium and includes a plurality of protrusions that is formed in each of both sides of the lower end of the paper medium. The plurality of protrusions formed on the guide may correspond to another plurality of protrusions formed on another guide. Since the support portion generally supports the central portion of the paper medium, it is possible to reduce friction between the support portion and the paper medium while the paper medium is being transferred.

The receiving portion may further include a guide being attached onto the support plate to limit both sides of the paper medium around the support portion. The guide may be formed in parallel with the transferring direction of the paper medium and may include the plurality of protrusions that is formed in each of both sides of the lower end of the paper medium. The plurality of protrusions formed on the guide may correspond to another plurality of protrusions formed on another guide.

When the paper medium is being transferred, the plurality of protrusions may support only the central portion of the paper medium and thus prevent both sides of the paper medium from being significantly tilted. Specifically, when the paper medium is tilted to one side, the plurality of protrusions may guide the tilted side to thereby make the paper medium be transferred as horizontally as possible.

Among the plurality of protrusions based on the support portion, the height of an outer protrusion may be formed to be less than or equal to the height of an inner protrusion. In particular, when the pressurizing portion starts pressurizing the paper medium, the height of the inner protrusion among the plurality of protrusions based on the support portion may be formed to be less than the height of the outer protrusion. However, as the paper medium is being transferred, the height of the inner protrusion may be equal to the height of the outer protrusion. The height of the plurality of protrusions may be formed to gradually increase along the transferring direction of paper medium. As the paper medium approaches the separating portion, the protrusions make the paper medium be arranged and picked up and discharged.

A section of the supporting portion may be formed in a T shape. The bottom surface of the pressurizing portion may be formed to correspond to the supporting portion. A slide groove may be formed in the support portion coupled with the pressurizing portion to slide the pressurizing portion. The slide groove may be formed along the transferring direction of the paper medium. The slide groove may be formed to be adjacent to the central portion of the support portion or both sides of the support portion.

BRIEF DESCRIPTION OF THE DRAWINGS

These and/or other aspects, features, and advantages of the invention will become apparent and more readily appreciated from the following description of exemplary embodiments, taken in conjunction with the accompanying drawings.

DETAILED DESCRIPTION

Figure 1:
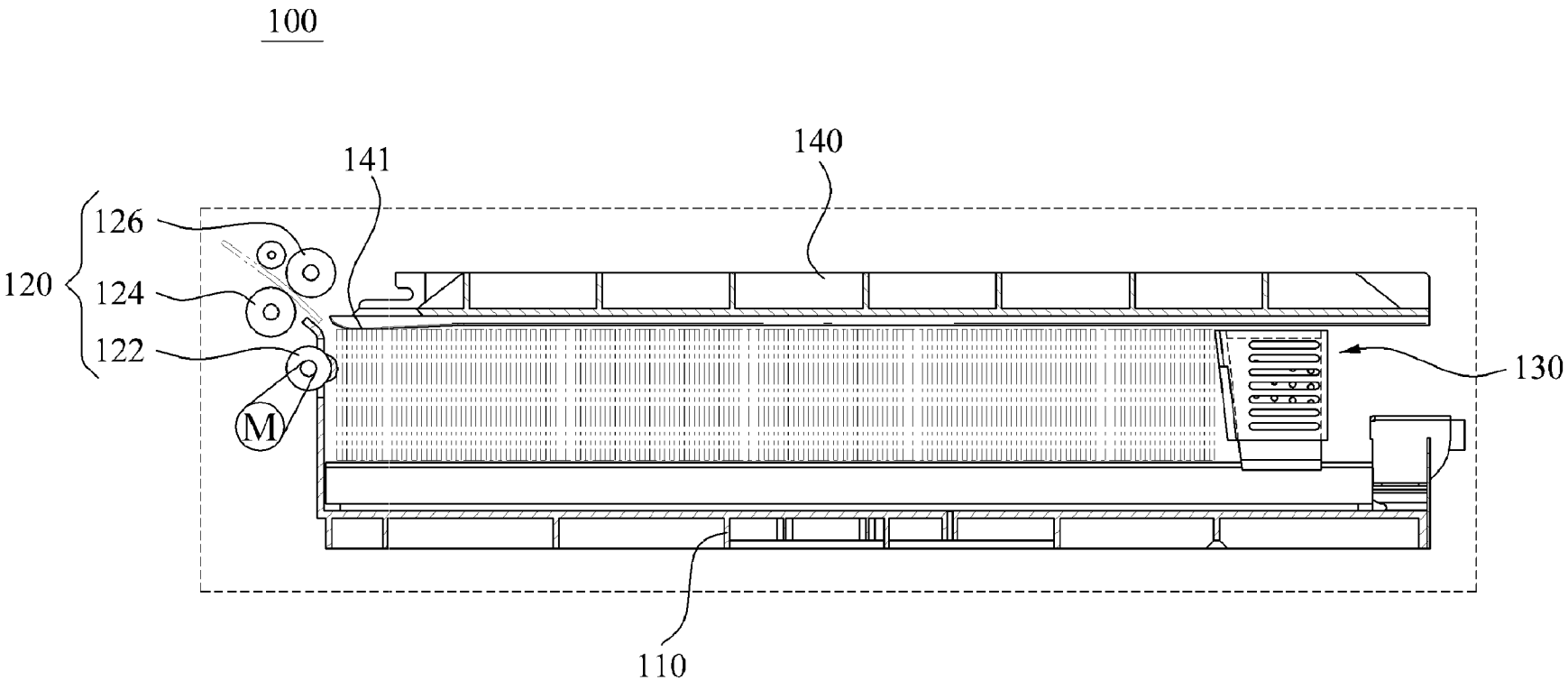
FIG. 1 is a cross-sectional view illustrating a medium supply device according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a cross-sectional view illustrating a medium supply device 100 according to an embodiment of the present invention.

Referring to FIG. 1, the paper medium device 100 of a cash transaction machine includes a receiving portion 110, a separating portion 120, a pressurizing portion 130, and a cover portion 140. The medium supply device 100 may be used to supply paper money, checks, gift cards, cards, and the like in the cash transaction machine. Generally, the medium supply device 100 may be a cassette that contains paper money or may be a storage section that is fixed to the cash transaction machine in order to load the paper money from a discharging module.

The receiving portion 110 may provide a space to receive a plurality of paper media and generally support the lower end of the received paper media. The plurality of paper media may be arranged in the receiving portion 110. Here, the longest side of the paper media may be loaded to contact with the bottom surface of the receiving portion 110. One end of a bundle of paper media may be pressurized by the pressurizing portion 130 and another end thereof may contact with the separating portion 120.

The separating portion 120 may be provided in front of the receiving portion 110. The separating portion 120 may be provided both as an internal type and as an external type. For example, when the separating portion 120 is provided as the internal type, a pickup roller 122, a feed roller 124, and a gate roller 126 may be embedded in the separating portion 120. When the separating portion 120 is provided as the external type, the pickup roller 122, the feed roller 124, and the gate roller 126 may be externally provided and installed with the medium supply device 100. In the present embodiment, when the separating portion 120 is provided as the external type will be described, but the present invention is not limited thereto or restricted thereby. Also, although the separating portion 120 generally uses the pickup roller 122, the feed roller 124, and the like, various types of devices may be used to pick up and separate paper media.

When the separating portion 120 is provided in the external type, the weight and the volume of a storage section and a cassette may be reduced as much as the weight and the volume of the pickup roller 122, the feed roller 124, and the like. Therefore, when an operator installs the cassette, the storage section, and the like in the cash transaction machine, it is possible to save time and man power.

The pressurizing portion 130 may be provided to face the separating portion 120. The pressurizing portion 130 functions to pressurize a roll of paper media toward the separating portion 120. The pressurizing portion 130 may pressurize the bottom surface of paper media to slide to the separating portion 120 and may also make the paper media closely contact with the separating portion 120 using a spring and the like.

The receiving portion 110 may provide a space for receiving the plurality of paper media and support the lower end of received paper media. The plurality of paper media may be well arranged in the receiving portion 110. According to the present embodiment, the longest side of paper media may be loaded to contact with the bottom surface of the receiving portion 110. One end of paper media may be pressurized by the pressurizing portion 130 and another end thereof may contact with the separating portion 120.

Also, an upper edge of the pressurizing portion 130 may be protruded further than a lower edge of the pressurizing portion 130 to thereby make the paper media continuously make close contact with the separating portion 120. A plate 132 of the pressurizing portion 130 may be tilted forward. The plate 132 functions to pressurize the rear of paper media and also may partially push the paper media to closely contact with the pickup roller 122. Through this, the plate 132 may help a pickup and discharge function.

The cover portion 140 may be provided on the receiving portion 110 to guide an upper portion of the paper media. The cover portion 140 may guide the upper portion of paper media so that the separating portion 120 my more easily pick up and discharge the paper media.

The cover portion 140 may be protruded toward the upper end of the paper media adjacent to the separating portion 120. The protruded cover portion 140 may arrange a skewed paper medium to be in an upright position. Specifically, a protrusion portion 141 is formed on the cover portion 140 to guide the skewed paper medium to be arranged in an upright position while the paper media is being transferred to the separating portion 120. For this, the cover portion 140 may include the protrusion portion 141 that is provided on one surface of the receiving portion 110 to make contact with a longest side of paper media and of which a portion corresponding to a central portion of the paper media is protruded further toward the receiving portion 110 than a portion corresponding to an edge portion of the paper media.

Here, the receiving portion 110, the separating portion 120, and the pressurizing portion 130 may be replaced by another type of device that is used for the cash transaction machine or any similar device thereto, or may be exchanged with another device.

Figure 2:
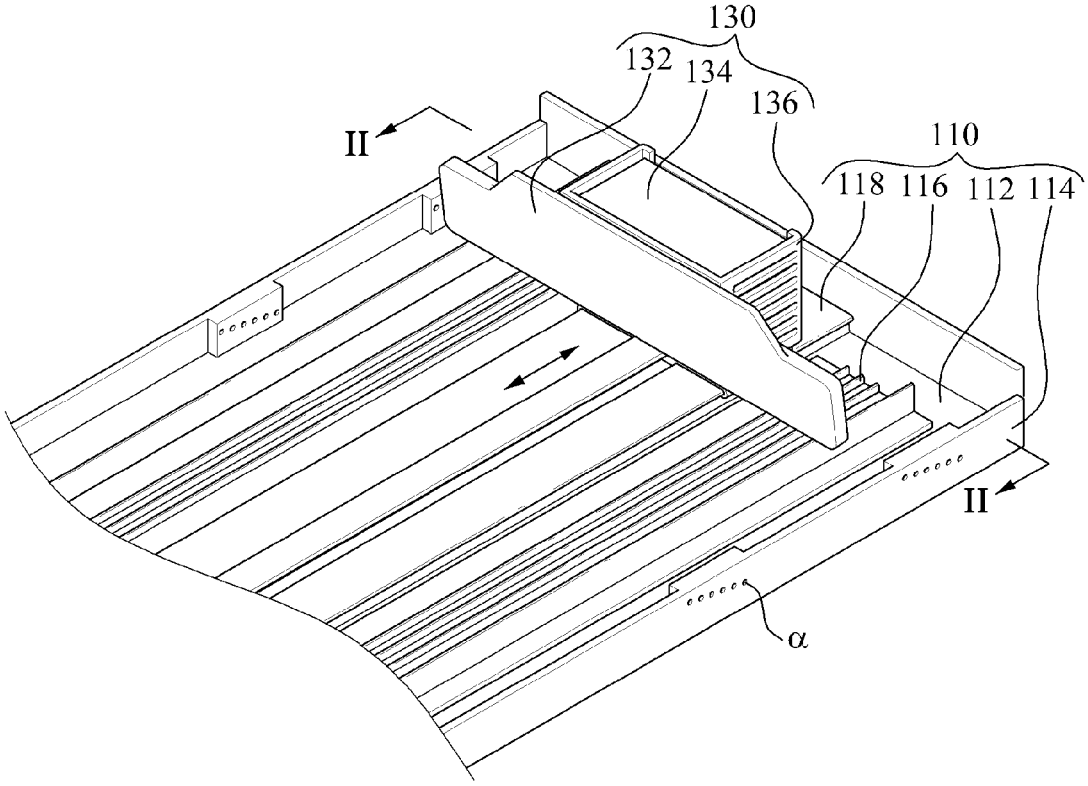
FIG. 2 is a perspective view illustrating the medium supply device of FIG. 1.
Figure 3:
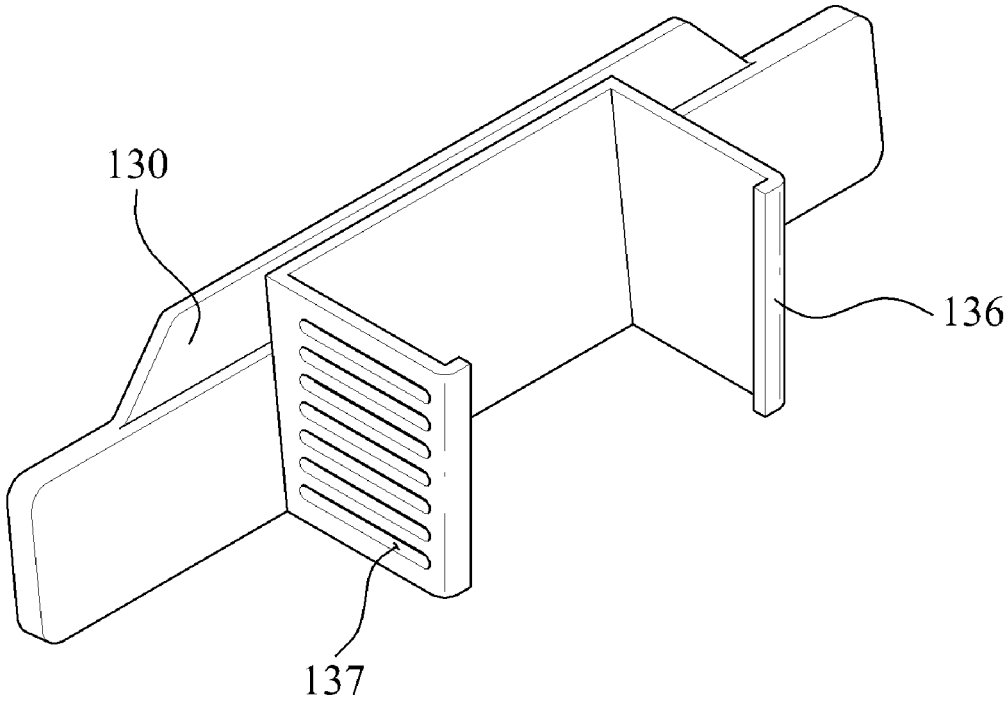
FIG. 3 is a perspective view illustrating a plate and a combining portion of FIG. 2.
Figure 4:
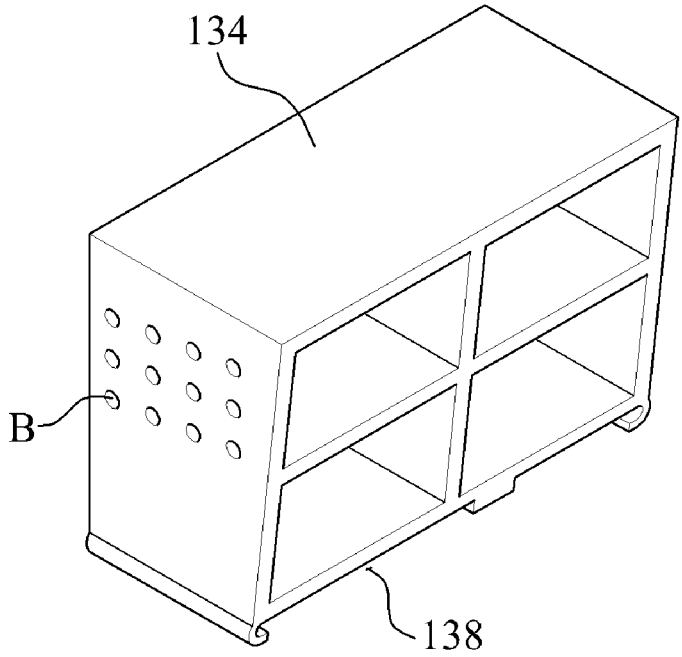
FIG. 4 is a perspective view illustrating a block of FIG. 2.
Figure 5:
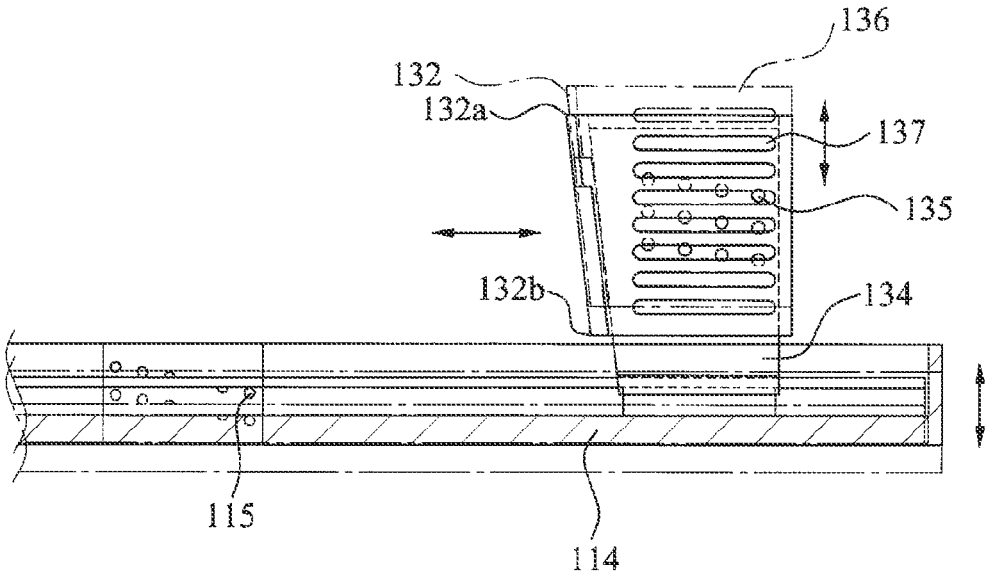
FIG. 5 is a cross-sectional view of the medium supply device of FIG. 2 cut along a line II-II.
Figure 6:
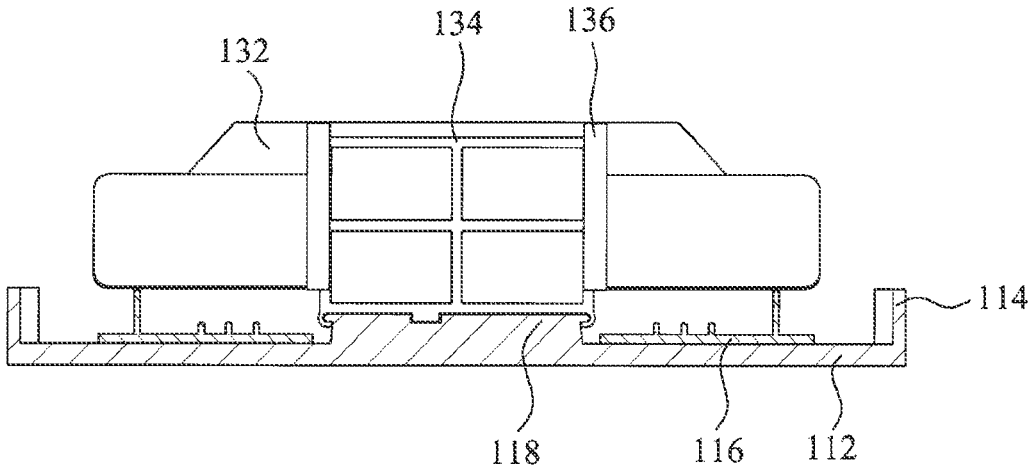
FIG. 6 is a cross-sectional view of the medium supply device of FIG. 2 illustrating upwardly and downwardly moving pressurizing portion and receiving portion.

FIG. 2 is a perspective view illustrating the medium supply device 100 of FIG. 1, FIG. 3 is a perspective view illustrating a plate 132 and a combining portion 136 of FIG. 2, FIG. 4 is a perspective view illustrating a block 134 of FIG. 2, FIG. 5 is a cross-sectional view of the medium supply device of FIG. 2 cut along a line II-II, and FIG. 6 is a cross-sectional view of the medium supply device of FIG. 2 illustrating upwardly and downwardly moving pressurizing portion 130 and receiving portion 110.

Referring to FIGS. 2 through 6, the pressurizing portion 130 includes the plate 132 and the block 134. The plate 132 may be provided to contact with one surface of paper media and to secure sufficient length to support the length of paper media. Also, an upper end of the pressurizing portion 130 may be protruded further than a lower end of the pressurizing portion 130 based on the receiving portion 110. Therefore, as the pressurizing portion 130 is being transferred to the separating portion 120, paper media may continuously make close contact with the pickup roller 120 whereby the paper media may be easily discharged.

The pressurizing portion 130 may include a combining portion 136 that is integrally provided with the plate 132 to fix the plate 132 to the block 134. The combining portion 136 may be provided in an L shape. At least one pair of L-shaped combining portions 136 may be provided to correspond to each other. The combining portion 136 may include at least one long hole 137. The long hole 137 may correspond to a screw hole B of the block 134.

The block 134 functions to move the plate 132 to the separating portion 120. The block 134 may include a plurality of screw holes B to fix the plate 132 via the combining portion 136. The plurality of screw holes B may be tilted along the side of the block 134. The plate 132 and the block 134 may be fixed using a member such as a screw via the screw hole B and the long hole 137.

The long hole 137 of the combining portion 136 and the screw hole B of the block 134 may make it possible to upwardly and downwardly adjust the plate 132. For example, the separating portion 120 may pick up and discharge the upper portion of paper media. In this instance, when the size of paper media increases, the upper portion of paper media may move to a downward direction of the receiving portion 110 in order to make close contact with the separating portion 120 receiving the paper media. Also, the pressurizing portion 130 may upwardly and downwardly adjust a location of paper media in order to pressurize the upper portion of paper media. Here, the plate 132 and the combining portion 136 may be positioned on the block 134 and the at least one fixing hole 137 and the plurality of screw holes B may be fixed in the block 134 using the screw and the like so that the transferring direction of the pressurizing portion 130 may satisfy a required specification.

The plurality of screw holes B formed on the block 134 may be tilted. A location of the plate 132 required according to a type of paper may be approximate to a previous location of the plate 132. When the plurality of screw holes is tilted, an interval between the screw holes B may be reduced and thus it is possible to approximately adjust the location of the plate 132. The direction of the screw hole B may be variously modified according to a required condition, a design specification, and the like, but the present invention is not limited thereto or restricted thereby.

In particular, the plate 132 may be tilted. As described above, the pressurizing portion 130 may make the paper media closely contact with the separating portion 120. In this instance, the pickup roller 122 of the separating portion 120 may be positioned to face the upper portion of the paper media. The pressurizing portion 130 may be tilted toward the upper end of paper media so that the upper end of paper media may be adjacent to the pickup roller 122. Therefore, as the upper end of the plate 132 is tilted relatively more than the lower end of the plate 132 based on the receiving portion 110, the paper media may effectively make close contact with the separating portion 120, helping to discharge the paper media. Here, the plate 132 is tilted but the present invention is not limited thereto. Specifically, the plate 132 may be formed without an inclined surface.

Referring again to FIGS. 2 and 6, the receiving portion 110 may include a support plate 112 to support the paper media. The support plate 112 may be upwardly and downwardly movable and fixable according to the size of paper media. As described above, the medium supply device 100 may upwardly and downwardly adjust and fix the receiving portion 110 and the pressurizing portion 130 according to the size of paper media.

A fixing plate 114 may be provided on each of both sides of the support plate 112. The fixing plate 114 may be vertically formed based on the support plate 112. A plurality of screw holes α may be formed in the fixing plate 114 and a location thereof may be adjustable according to paper media. The size, the height, and the like of paper media may be different according to a type of paper and thus there is a need to adjust the size and the height according to the type of paper. Therefore, it is possible to move the support plate 112 upwardly and downwardly according to the height of the type of paper. It is possible to fix the support plate 112 at a desired location and then combine the screw hole α of the fixing plate 114 and an external long hole (not shown) using a screw. A pickup location according to the type of paper may be adjusted by adjusting the height of the support plate 112. The paper media may be more easily picked up and discharged from the separating portion 120.

The screw holes α formed in the fixing plate 114 may be tilted along the lengthwise direction of the support plate 112 like the screw holes B formed in the block 134. When the screw holes α are vertically arranged, an adjustable interval using a screw hole may be greater than the minimum diameter of the screw hole. According to the present embodiment, the height of the support plate 112 may be adjusted to be an interval less than the diameter of the screw hole by forming the screw holes α to be tilted and forming the long holes corresponding to the screw holes. Specifically, the height of the support plate 112 may be approximately adjusted using the tilted screw holes and their corresponding long holes.

The width of the receiving portion 110 may be adjustable on the support plate 112 and may include the medium guide 116 to limit both sides of the paper media. The medium guide 116 may define and guide both ends of the paper media. Also, the medium guide 116 may be movable to the left and right sides and be fixable according to a type of paper. In order to reduce friction with the paper media, the medium guide 116 may further include a receiving protrusion that maintains a separated state from the bottom surface of paper media and is formed in the lengthwise direction.

The support plate 112 may include a guide support portion 118 that is formed in the transferring direction of paper media and is protruded from the support plate 112. The guide support portion 118 has a T-shaped section. The width of the guide support portion 118 is formed to be less than the width of paper media to reduce friction between the bottom surface of the receiving portion 110 and paper media. Also, since both ends of the paper media are in the air by the guide support portion 118, the paper media may be easily horizontally positioned and be uprightly arranged.

In particular, the block 134 receives the guide support portion 118 to slide the block 134 to the separating portion 120. Here, the block 134 may further include a block receiving portion 138 to receive the upper portion of the guide support portion 118. Both sides of the block receiving portion 138 are finished to be curved whereby the block 134 may slide on the guide support portion 118. A T-shaped upper portion of the receiving portion 110 may relatively secure combining of the guide support portion 118 and the bottom surface of the block 134.

Figure 7:
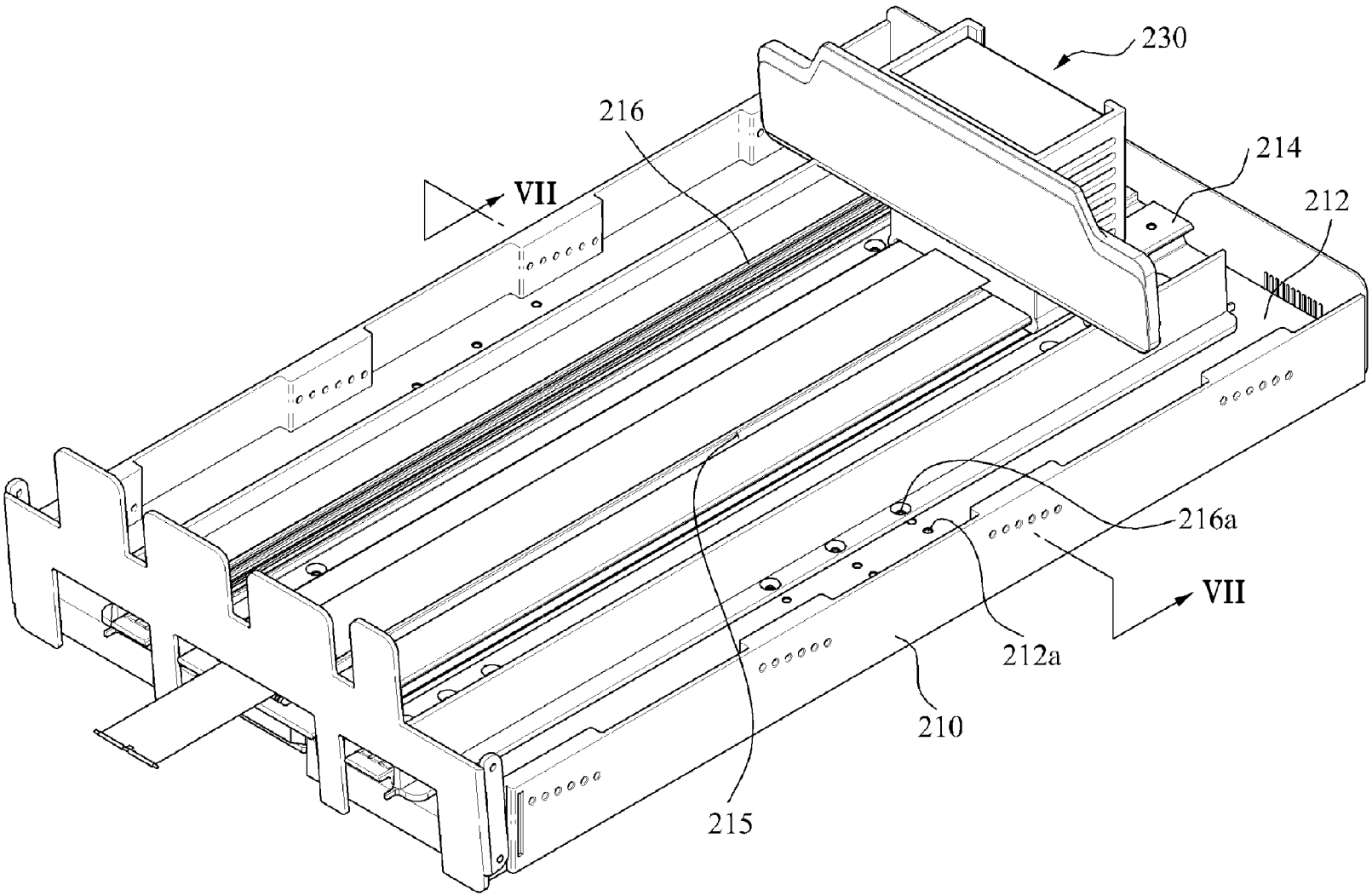
FIG. 7 is a perspective view illustrating a receiving portion and a pressurizing portion of a medium supply device according to another embodiment of the present invention.
Figure 8A:
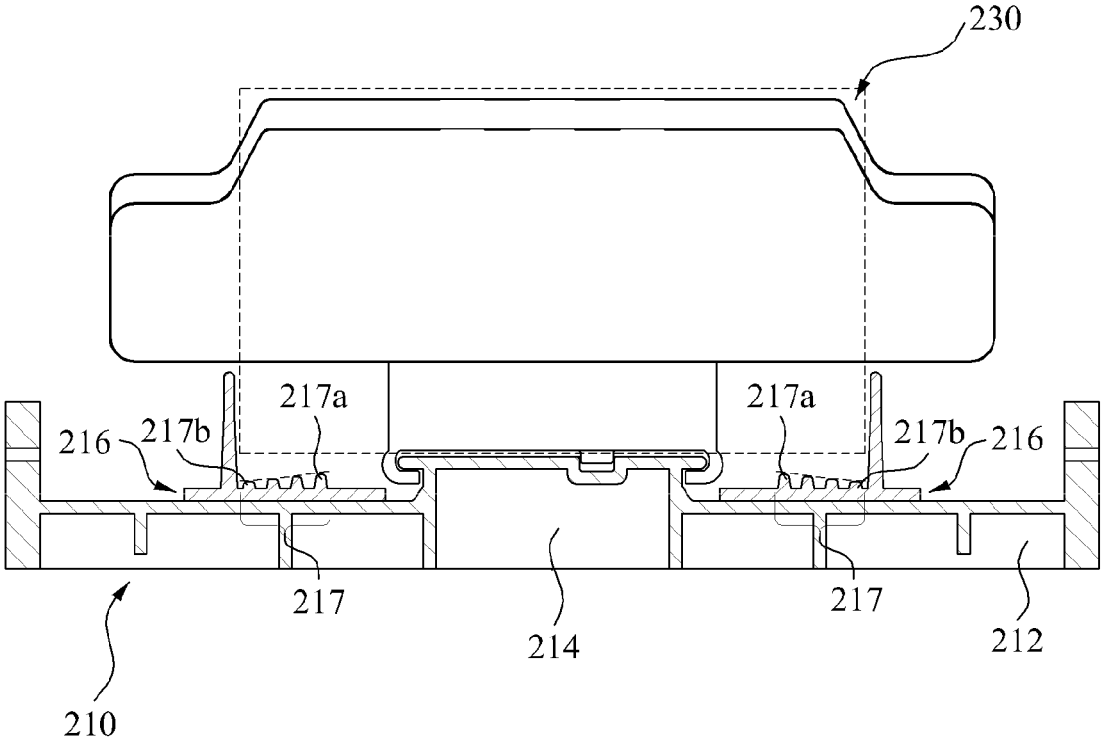
FIGS. 8A, 8B, and 8C are cross-sectional views of the other medium supply device of FIG. 7 cut along a line VII-VII and illustrating the shape of a guide of FIG. 7.
Figure 8B:
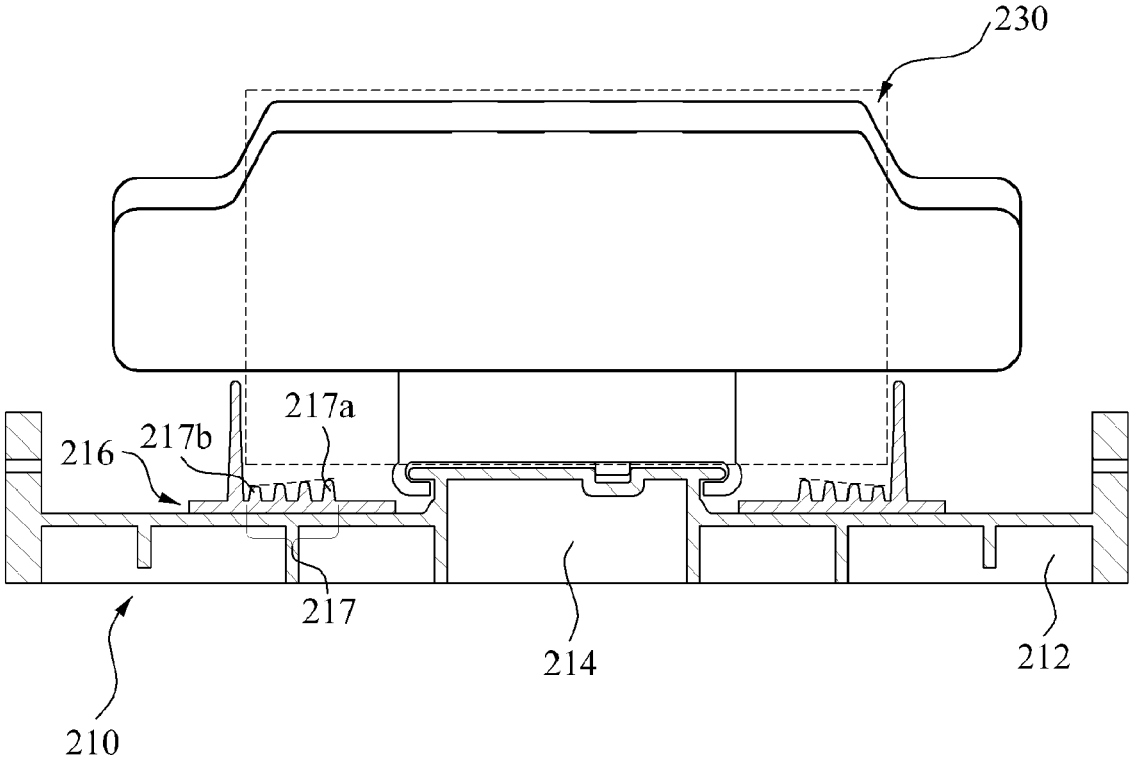
Figure 8C:
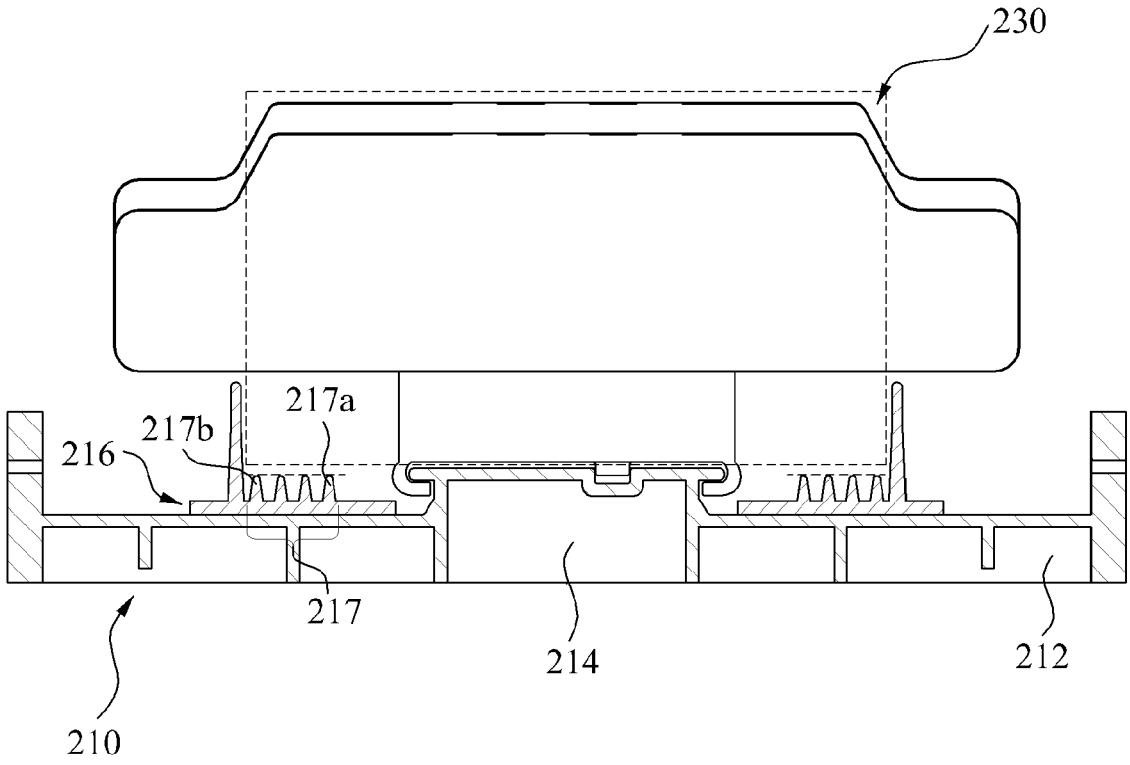
Figure 9:
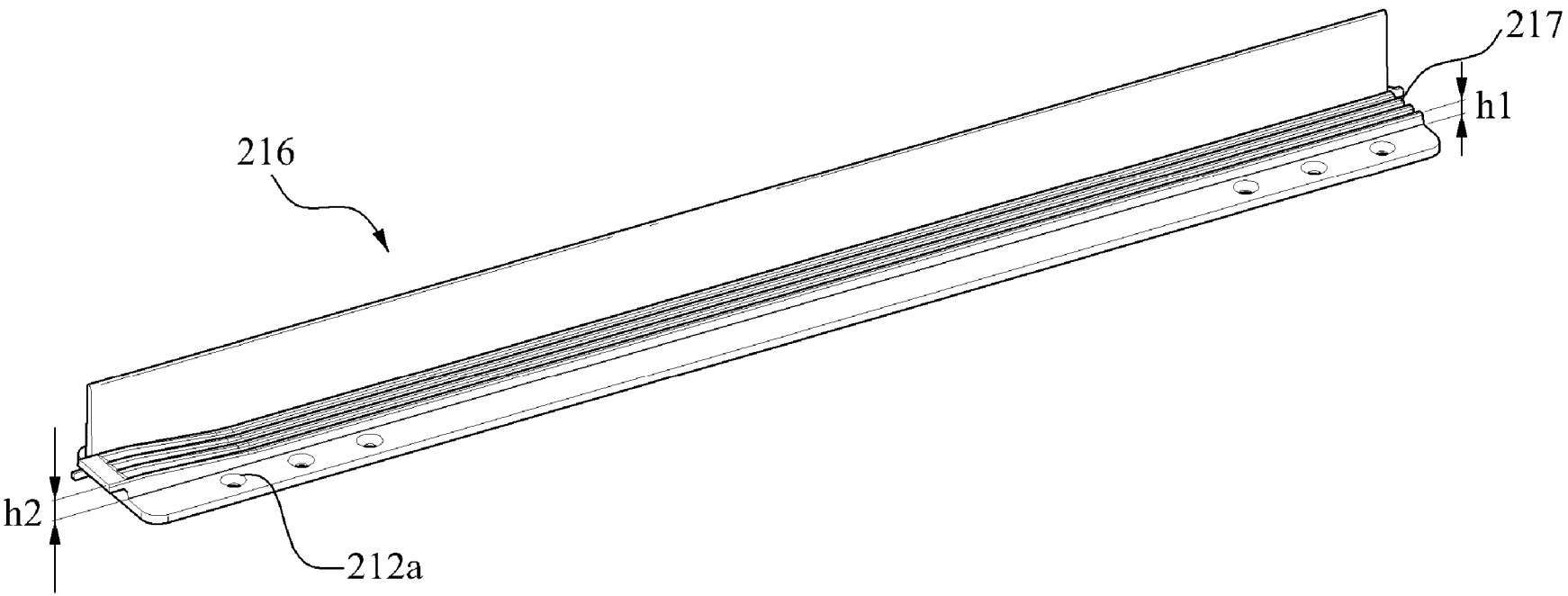
FIG. 9 is a perspective view illustrating the shape of a support portion of FIG. 7 according to a transferring direction of a paper medium.
Figure 10:
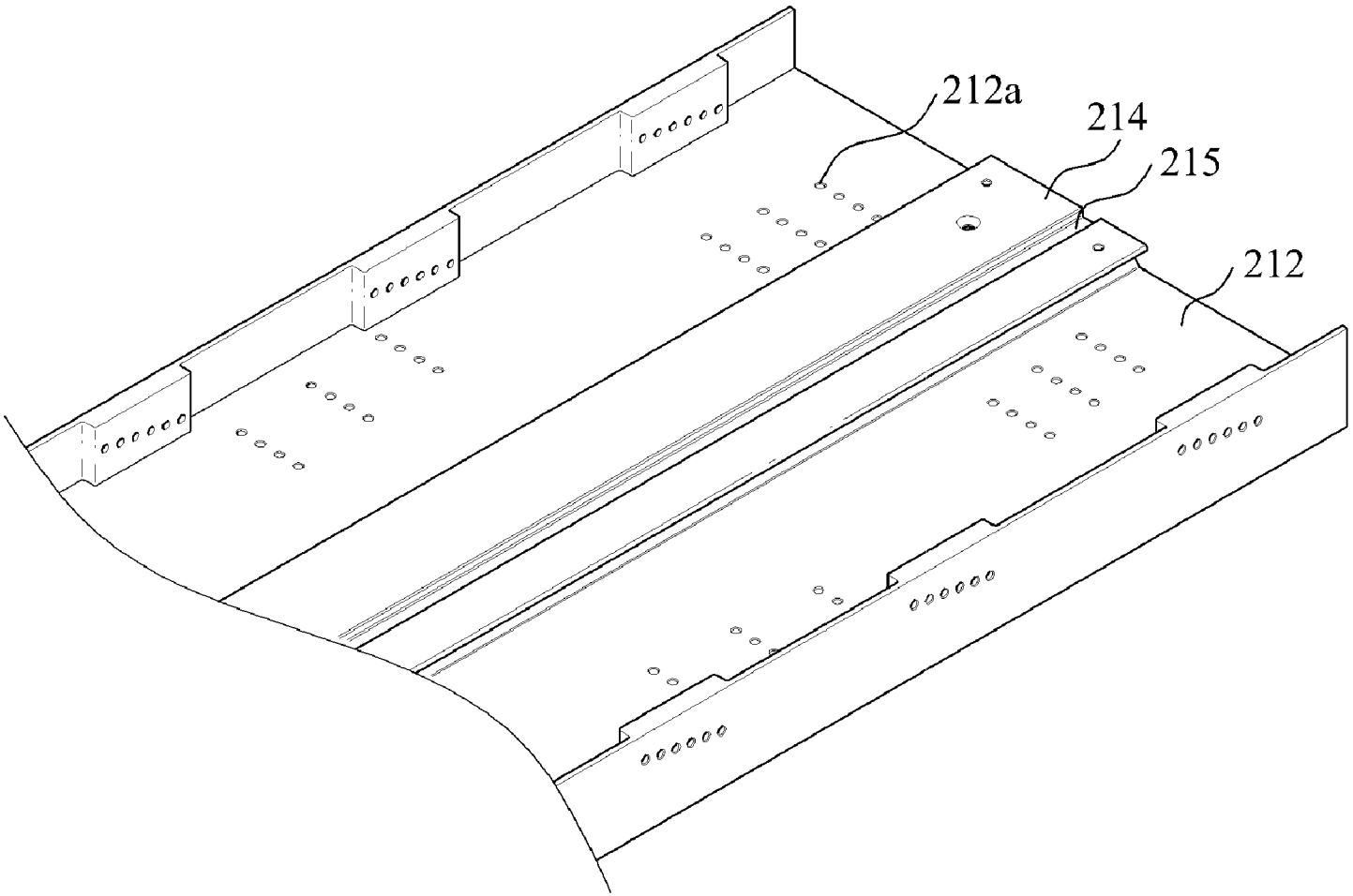
FIG. 10 is a perspective view illustrating a receiving portion of FIG. 7.

FIG. 7 is a perspective view illustrating a receiving portion 210 and a pressurizing portion of a medium supply device according to another embodiment of the present invention, FIGS. 8A through 8C are cross-sectional views of the other medium supply device of FIG. 7 cut along a line VII-VII of FIG. 7 and illustrating the shape of a guide of FIG. 7, FIG. 9 is a perspective view illustrating the shape of a support portion of FIG. 7 according to a transferring direction of a paper medium, and FIG. 10 is a perspective view illustrating a receiving portion 210 of FIG. 7.

Referring to FIGS. 7 through 10, the receiving portion 210 may include a support plate 212, a support portion 214, and a guide 216. The support plate 212 may form the bottom surface of the receiving portion 210 and the support portion 214 may be formed on the support plate 212. In particular, the support portion 214 may be provided on a central portion of the support plate 212 to support a central portion of paper media.

The receiving portion 210 may include the guide 216 that is formed on the support plate 212 to limit both sides of paper media to both sides of the support portion 214. The guide 216 may be formed to be parallel with a transferring direction of paper media and may include a plurality of protrusions 217 that is formed in each of both sides of the lower end of paper media. The plurality of protrusions formed on the guide may correspond to another plurality of protrusions formed on another guide.

Here, the height of an inner protrusion 217*a* may be formed to be greater than or equal to the height of an outer protrusion 217*b* based on the support portion 214. In particular, the height of the inner protrusion 217*a* may be formed to be greater than the height of the outer protrusion 217*b* based on the support portion 214 from a location where the pressurizing portion 230 starts pressurizing the paper media. In a location where the paper media is adjacent to the separating portion 130, the height of the inner protrusion 217*a* and the height of the outer protrusion 217*b* may be uniformly formed. Also, the protrusion 217 may have a low height h1 in a rear portion of the guide 216, whereas the height of the protrusion 217 may increase to be the approximately the same height h2 as the support portion 214 as the paper media approaches the separating portion 120. The increasing height of the protrusions 217 may be limited to be less than or equal to the height of the support portion 214 supporting the central portion of paper media.

When the paper media is being transferred in the medium supply device 100, the support portion 214 may support the central portion of paper media and thus both sides of paper media may be transferred afloat in the air. In this instance, the plurality of protrusions 217 may guide both sides of paper media tilted in the transferring direction of paper media and thereby make it possible to arrange and uprightly transfer the paper media. While approaching the separating portion 120, the height of the protrusions 217 may gradually increase, so that the paper media may be easily picked up and discharged in an upward direction via the separating portion 120.

A location of the guide 216 may be adjustable vertically with respect to the transferring direction of paper media. Specifically, the length of paper media may be different according to a type of paper and thus both sides of paper media may be limited by adjusting the location of the guide 216 into the lengthwise direction of paper media. Here, the guide 216 may include a plurality of screw holes 216*a* so that the guide 216 may be fixed to the support plate 212. The support plate 212 may include a plurality of screw holes 212*a* corresponding to the plurality of screw holes 216*a* formed in the guide 216.

Referring again to the accompanying figures, the support portion 214 may be provided to support the central portion of paper media. According to an embodiment of the present invention, the support portion 214 may be integrally provided with the support plate 212. Depending on embodiments, the support portion 214 may be separately provided and attached onto the support plate 212. However, the present invention is not limited thereto or restricted thereby.

The support plate 212 may be upwardly and downwardly movable and adjustable according to a type of paper. The separating portion 120 of FIG. 1 may pick up and discharge the upper end of paper media. However, each type of paper has a different length and width. Also, the fixed separating portion 120 is provided. Therefore, so that the separating portion 120 may easily pick up the upper end of paper media, the support plate 212 receiving the paper media may be upwardly and downwardly moved to thereby easily discharge the paper media.

Here, a slide groove 215 may be formed in the support portion 214 to confine the pressurizing portion 230 that may pressurize the bottom surface of paper media and thereby slide. The slide groove 215 may be formed to be adjacent to the central portion of the support portion 214 or the side of the support portion 214. The slide groove 215 may be formed in various types of shapes to enable easy sliding of the pressurizing portion 230.

The support portion 214 may have a T-shaped section. The bottom surface of the pressurizing portion 230 may be formed in a corresponding shape to the support portion 214. A combining region of the bottom surface of the pressurizing portion 230 and the support portion 214 may be in a round shape, which may make the pressurizing portion 230 more smoothly slide on the support portion 214.

When the support portion 214 supports only the central portion of paper media, friction between the paper media and the support portion 214 may be reduced while the paper media is being transferred to the pressurizing portion 230. Through this, the paper media may be smoothly transferred. Also, while approaching the separating portion 120, the height of the protrusions 217 gradually increases, preventing both sides of paper media from moving while the paper media is being transferred to the separating portion 120. Therefore, a roll of paper media may be transferred as horizontally as possible. When the paper media is horizontally transferred, pickup and discharge of the paper media may be further easier, which results in preventing a jam and the like in the cash transaction machine.

According to a medium supply device of the present invention, there is provided a pressurizing portion that may pressurize the bottom surface of paper media. As an upper end of the pressurizing portion is protruded further than a lower end of the pressurizing portion, the upper end of paper media may easily make close contact with the separating portion. Through this, the paper media may be more effectively discharged.

Also, according to a medium supply device of the present invention, a separating portion discharging paper media may be externally provided. Therefore, volume, weight, and the like, of a cassette, a paper money storage section, and the like, may be reduced. Also, an operator may reduce a time and man power that is required to install the cassette, the storage section, and the like in a cash transaction machine.

According to embodiments of the present invention, there is provided a medium supply device that may support only a central portion of paper media and thereby reduce friction between the paper media and a device and smoothly transfer the paper media. A support portion supporting the paper media may generally support the central portion of paper media. Since the friction between the paper media and the support portion occurs from the central portion of paper media, the friction between the paper media and the support portion may be reduced to thereby enable smooth transferring of the paper media.

Also, according to embodiments of the present invention, there is provided a medium supply device that includes a guide to limit both sides of paper media and a plurality of protrusions to transfer the paper media as horizontally as possible and thereby enables the paper media to be easily picked up and discharged. The plurality of protrusions may prevent both sides of the paper media from being skewed while the paper media is being transferred. Since the height of the protrusions gradually increases along the transferring direction of the paper media, a separating portion may easily pick up and discharge the paper media.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A medium supply device for supplying a paper medium in a cash transaction machine, comprising:

a receiving portion to receive the paper medium;

a separating portion being provided in a front top of the receiving portion to upwardly pick up and discharge the paper medium;

a pressurizing portion comprising a block to move forward and backward with respect to the receiving portion and a plate of which a location is adjustable upwardly and downwardly along the block wherein the pressurizing portion includes a combining portion that is formed in the plate to be combinable with the block, at least one long hole horizontally formed on a side of the combining portion, and a plurality of tilted screw holes arranged on a side of the block in correspondence to the at least one long hole.

2. The device of claim 1, wherein the combining portion is upwardly and downwardly combined with the block.

3. The device of claim 1, wherein an upper end of the plate facing the separating portion is protruded further towards the separating portion than a lower end of the plate.

4. The device of claim 1, wherein:

a cover portion is provided on the receiving portion to guide an upper portion of the paper medium, and includes a protrusion portion that is provided on one surface of the receiving portion to make contact with a longest side of the paper medium and of which a portion corresponding to a central portion of the paper medium is protruded further toward the receiving portion than a portion corresponding to an edge portion of the paper medium.

5. A medium supply device for supplying a paper medium in a cash transaction machine, comprising:

a receiving portion to receive the paper medium;

a separating portion being provided in a front top of the receiving portion to upwardly pick up and discharge the paper medium; and a pressurizing portion comprising a block to move forward and backward with respect to the receiving portion and a plate of which a location is adjustable upwardly and downwardly along the block, wherein the receiving portion includes a support plate to support a bottom surface of the paper medium, and the support plate is upwardly and downwardly movable and fixable with respect to the separating portion, and wherein a fixing plate is vertically formed on each of both sides of the support plate, and a plurality of tilted screw holes is formed in the fixing plate.

6. The device of claim 5, wherein the support plate includes a guide support portion that is protruded from a bottom surface of the support plate along a transferring direction of the paper medium, and the guide support portion is combined with the block to guide forward and backward sliding of the block.

* * * * *